United States Patent [19]

Farag et al.

[11] 4,076,552

[45] Feb. 28, 1978

[54] PROCESS FOR DECOLORIZING SUGAR SOLUTIONS WITH PEROXIDE

[75] Inventors: Souly Atalla Farag; Lloyd Wendell Norman, both of Moses Lake, Wash.

[73] Assignee: U and I Incorporated, Salt Lake City, Utah

[21] Appl. No.: 717,154

[22] Filed: Aug. 24, 1976

[51] Int. Cl.[2] ..... C13D 3/06; C13D 3/10

[52] U.S. Cl. ..... 127/50; 127/46 R; 127/48; 127/52

[58] Field of Search ..... 127/42, 46 R, 50, 51, 127/52, 48

[56] References Cited

U.S. PATENT DOCUMENTS

| | | | |
|---|---|---|---|
| 2,072,639 | 3/1937 | Kauffmann | 127/50 |
| 2,082,656 | 6/1937 | Reichert | 127/46 R |
| 2,360,586 | 10/1944 | Row | 127/51 |
| 2,515,690 | 7/1950 | Bernaldes | 127/52 X |
| 3,248,264 | 4/1966 | Welch | 127/51 X |

FOREIGN PATENT DOCUMENTS 324,248 8/1975 Austria.

OTHER PUBLICATIONS

Sugar Industry Abstracts, 37(11):1514 (1975).

"Principles of Sugar Technology," P. Honig, ed., 627-654, Elsevier Publishing Co., Amsterdam, 1953.

"Beet-Sugar Technology," R. A. McGinnis, ed. 2nd Edition, 268-274, Beet Sugar Development, Fort Collins, 1971.

*Primary Examiner*—Sidney Marantz

*Attorney, Agent, or Firm*—Mallinckrodt & Mallinckrodt

[57] ABSTRACT

A process for treating a raw sugar-containing juice which includes liming, adding hydrogen peroxide, carbonating, filtering the juice to remove the thusly produced calcium carbonate and contacting the filtered juice with $SO_2$. The treatment results in a decolorized juice which is rendered thermally stable relative to further color formation; the viscosity and the bacterial content of the juice are reduced.

7 Claims, No Drawings

PROCESS FOR DECOLORIZING SUGAR SOLUTIONS WITH PEROXIDE

BACKGROUND OF THE INVENTION

FIELD

This invention pertains broadly to the refining of sugar from sugar-containing plants, and, in particular, to decolorizing colored matter in sugar-containing juices and removing color precursors from the sugar-containing juices.

State of the Art

The process of sugar refining involves four fundamental steps: extraction, purification, concentration, and crystalization. Extraction is accomplished by expression of juices from sugar cane and by diffusion with water from other sugar-containing plants such as sugar beets. The sugar-containing juices from the extraction are purified by being contacted with lime or a liming agent and carbon dioxide. Preferably, the carbonation, i.e. carbon dioxide contact is effected in two stages with the precipitated calcium carbonate generated in the first carbonation stage being removed from the sugar juices prior to the second carbonation stage. The calcium carbonate from the second carbonation stage is removed and the juices are concentrated by evaporation. Sugar is then crystallized from the concentrated juices.

The purified solutions from which the sugar is recovered by crystallization may frequently contain a detrimental amount of color bodies, which at times are present in sufficient quantity to render the recovery of sugar of satisfactory quality (essentially color free) either extremely difficult or impossible. Good purification practice (liming and carbonation), together with treating of the sugar-containing juices with sulfur dioxide just prior to the concentration step, are the principal steps which have been used in controlling color. These steps are effective in reducing the color of the juices at the time of treatment; however, they are not effective in removing color precursors, which are susceptible to being formed into colored matter in the juices during subsequent steps in the refining process, particularly, in the concentration step which is conducted at elevated temperatures.

In a process separate and apart from the conventional steps or stages of refining sugar, it has been suggested to add hydrogen peroxide to sugar juices at elevated temperatures of between 60° and 90° C, followed by passing the juices through a filter selected from the group selected from activated charcoal, bone charcoal, and activated silica (see U.S. Pat. No. 2,085,425).

SUMMARY OF THE INVENTION

In accordance with the present invention, colored matter in crude juices obtained from the extraction of sugar-containing plants is decolorized, and the juices are rendered thermostable with respect to subsequent color formation by removal of color precursors, i.e., compounds which are unstable, and, unless removed from the juices, form additional colored matter, especially when subjected to elevated temperatures. The colored matter is decolorized and the color precursors are removed in conjunction with and during the conventional stages in the refining of sugar.

In the production of sugar from sugar-containing plants such as sugar beets, the sugar content is extracted from the plants using diffusion with water to produce a crude, aqueous, sugar-containing juice. With sugar cane, the sugar juices are expressed from the sugar cane plants as a crude, aqueous, sugar-containing juice. Lime, slaked lime, milk of lime, or saccharate milk is added to the crude juice, and the juice is then subjected to carbonation, i.e. contacted with carbon dioxide. Preferably, the carbonation is accomplished in two stages, with the juice being subjected to sedimentation and filtration between the two carbon dioxide contact stages. As is well established in sugar refining technology, the liming agent is added to the sugar juice either concurrently with or previous to the carbonation and in amounts as necessary to precipitate anionic impurities in the juice and to produce finely divided, precipitated calcium carbonate in the juice during the carbonation. Colored matter and color precursors present in the sugar juices coming from the extraction stage are rendered amenable to removal from the juices during the carbonation by adding from about 0.01 to 0.4 percent by weight of a peroxide selected from the groups consisting of alkali metal peroxides and hydrogen peroxide to the sugar juices prior to or simultaneously with the carbonation.

The peroxide, in the proper amounts, decolorizes the colored matter by converting the colored bodies to noncolored impurities in the juices, and renders the remaining colored matter, the noncolored impurities, and color precursors in the juices amenable to being removed by the freshly precipitated calcium carbonate which is generated in the carbonation stage. The resulting juices, from which the color precursors have been removed, are essentially thermally stable relative to any substantial color formation during the subsequent evaporation and crystallization stages of the refining, i.e. manufacturing process.

If the carbonation is accomplished in two stages, the peroxide can be added to the juices either prior to or simultaneously with the addition of the carbon dioxide during either or both of the carbonation stages. All of the peroxide can be added prior to or during the first stage of the carbonation, or a part of it can be added prior to or during the first stage with the remainder being added prior to or during the second stage of the carbonation. However, it has been found especially advantageous to add all the peroxide prior to or simultaneously with the addition of the carbon dioxide during the second stage of the carbonation. In the latter instance, it has been found that the pH of the juices during the first stage of the carbonation should be maintained within a range of about 10.4 to 11.1.

Following the addition of carbon dioxide to the sugar juice and the filtration of the precipitated calcium carbonate therefrom, it is conventional practice in the sugar refining industry to introduce $SO_2$ into the sugar juice. This is advantageous in the present process, for it results in the removal of any traces of peroxide which remain after the precipitation and removal of calcium carbonate from the sugar juice. Presence of any peroxide during the concentration and crystallization stages of the refining process have been found to have a detrimental effect on the quality of sugar being produced. The $SO_2$ treatment removes all traces of residual peroxide from the sugar juice.

Concentration of the purified juice is preferably accomplished by multiple effect evaporation following the treatment with $SO_2$. Having had color precursors removed with the precipitated calcium carbonate, the juice is essentially color stable during the concentration stage of the refining. In the final stage of the refining process, sugar is crystallized from the concentrated juice, perferably by batch, in single effect vacuum pans.

DETAILED DESCRIPTION OF THE PREFERRED EMBODIMENT

The best mode presently contemplated of carrying out the present invention comprises extracting sugar from sugar-containing plants, such as sugar beets, by diffusion with water to produce an aqueous juice containing sugar and other impurities including colored matter and color precursors. The juices are then subjected to a series of steps to remove impurities from and otherwise refine the sugar solutions. Lime, slaked lime, milk of lime, or saccharate milk is added to the juices from the extraction stage in amounts as needed to precipitate anionic impurities and for generation of calcium carbonate when the juices are treated with gaseous carbon dioxide in the next step of the process. The carbonation, i.e., treatment with carbon dioxide, is usually carried out in two stages.

Gaseous carbon dioxide is added to the juices in the first carbonation stage in an amount to maintain the pH of the juices within the range of from about 10.4 to 11.1, preferably within the range of 10.7 to 11.1. The resulting slurry is then subjected to sedimentation and filtration for the removal of solids. Prior to treating the filtered juices in the second carbonation stage, a peroxide selected from the group consisting of alkali metal peroxides and hydrogen peroxide is added to the juices in an amount of between about 0.01 to 0.4 percent by weight. The peroxide-treated juices are then contacted with carbon dioxide in the second stage of the carbonation. Sufficient carbon dioxide is mixed with the juices in the second stage carbonation to precipitate essentially all the calcium content of the juices as finely divided calcium carbonate and to maintain a pH of the juices within the range of from about 9.0 to 9.5, preferably from about 9.2 to 9.3. While the peroxide can be added to the juices at any point prior to the second stage carbonation stage, i.e. during the extraction, or to the extraction juice, during or following the liming, or prior to or during the first stage of the carbonation, it has been found preferable to add the peroxide to the juices just prior to the second stage of the carbonation.

Following the second stage of the carbonation, th slurry is subjected to filtration to produce a clear, purified juice. The clear juice is then treated with $SO_2$ as is customary in conventional sugar refining. The $SO_2$ reacts with any residual peroxide which was not consumed in the carbonation and filtration steps. The juices are then concentrated by evaporation, and sugar is crystallized from the concentrated juices by single effect vacuum crystallization.

In addition to reducing the color of the sugar juices and removing color precursors therefrom, the process of the present invention produces a significant reduction in the bacterial content or count of the sugar juices.

The invention will be illustrated and further described with reference to the following examples. In the experimental work included in the examples, food grade hydrogen peroxide (35%) was used, although peroxide concentrations from 30% to 90% can be used. The percentage peroxide in the tests reported in the examples are calculated on the basis of 100% active peroxide.

Simulated factory conditions were employed. Liming was done with either lime or saccharate milk, and a two stage carbonation followed. The resulting second carbonation juice was treated with $SO_2$ gas, and concentration of the purified juice was done in an open beaker over direct heat to a standard 68 refractometer dry solids (R.D.S.). A piece of iron wire was added to simulate the catalytic effect of ferrous ion on color development. Color was determined using the Coleman Junior spectrophotometer corrected for R.D. S. The color is measured in terms of transmittance at 440 mu in a ¾ inch diameter tube. The color is calculated from the equation:

$$\text{Color} = \frac{17}{R.D.S.} \left(\log \frac{1}{T}\right) \times 100$$

where T is the transmittance obtained by the spectrophotometer.

EXAMPLE 1

Hydrogen peroxide was added to the diffusion juices obtained following the extraction of sugar beets with water. The amount of peroxide added to the juices was about 0.03% by weight. Following the addition of the peroxide, the juices were subjected to the normal liming, carbonation, $SO_2$ treatment and concentration. Results are compared in Table 1 with a control sample to which no peroxide had been added. Thin juice is the juice prior to concentration and thick juice is that following concentration.

TABLE 1

| | Color | | |
|---|---|---|---|
| | Thin Juice | Thick Juice | Thick Juice After 12 Hours |
| Control Sample | 64 | 95 | 193 |
| 0.03% peroxide | 48 | 49 | 133 |

As can be seen, the decolorizing effect is pronounced, and the juices to which the peroxide was added were far more thermostable with respect to further color development than the control sample.

In addition, the addition of peroxide resulted in a substantial reduction in viscosity of the juices. In the control sample, having an R.D.S. value of 67.9, the viscosity was about 1624 centipoise. In a sample to which 0.06% by weight peroxide had been added prior to liming, the viscosity of the concentrated juices, having an R.D.S. value of 67.0, was about 1320 centipoise. Viscosities were measured at room temperatures using a Brookfield viscometer.

EXAMPLE 2

Hydrogen peroxide was added to the sugar-containing juices obtained following the first carbonation in an amount of about 0.02% peroxide by weight, and resulted in a substantial decrease in the color of the thick juice obtained following normal concentration of the solution. The degree in reduction of color was dependent on the pH which had been maintained in the first carbonation step. The percent color change of samples to which the peroxide was added as compared to the corresponding control samples to which no peroxide was added is shown in Table 2.

TABLE 2

| pH of Solution in 1st Carbonation | Percent Color Change |
|---|---|
| 10.3 | 10.6 increase |
| 10.52 | 14.1 decrease |
| 10.65 | 19.4 decrease |
| 11 | 32 decrease |

As indicated, the pH of the first carbonation stage should be maintained at a value greater than about 10.3. The results of this example confirms the importance of the absorptive effect of the precipitated calcium carbonate in combination with the peroxide in reducing the color levels of the sugar-containing juices. When the pH of the first stage of the carbonation is operated at a pH of 10.3 or less, reduced amounts of calcium carbonate precipitate in the second stage of carbonation. When the first stage is operated at a pH of above 10.3, the amount of calcium carbonate precipitated in the second stage is significantly increased. In those tests wherein the calcium carbonate was largely removed from the solution prior to addition of peroxide, little reduction in color is achieved, and, in fact, the peroxide treatment can result in an increase in color. When the peroxide treatment preceeds or is accomplished simultaneously with the precipitation of effective amounts of calcium carbonate, the color of the solution is reduced significantly.

EXAMPLE 3

Thick juice, obtained following concentration of juice obtained by conventional processing techniques, i.e. no peroxide treatment had been used, was diluted to the consistency of the juice prior to concentration. Hydrogen peroxide was added to the diluted juice in an amount of 0.1% peroxide by weight based on the thick juice. Approximately 90 seconds after addition of the peroxide, the juice was subjected to the conventional liming, carbonation in two steps, treatment with $SO_2$, and concentration. The color of the resulting juice was 119 in comparison to 144 for the initial thick juice. After the original thick juice had aged for 6 hours its color was measured as 175; whereas, the color of the juice which was treated with peroxide and then aged for 6 hours was only 131.

The temperatures and pressures during the peroxide treatment and subsequent carbonation were found not to be critical. The temperatures and pressures used during the conventional refining of sugar juices are entirely satisfactory.

We claim:

1. A process for recovering sugar from a raw sugar-containing juice extracted from sugar-containing plant material, comprising adding lime, slaked lime, milk of lime, or saccharate milk to the juice; adding from about 0.01 to 0.4 percent by weight of peroxide selected from the group consisting of alkali metal peroxides and hydrogen peroxide to the juice; contacting the juice with sufficient carbon dioxide so that the pH of the juice is about 10.4 or greater, said addition of peroxide being made either prior to or simultaneously with the contacting of the juice with carbon dioxide; filtering the juice to remove precipitated calcium carbonate, together with colored matter, and color precursors, therefrom; treating the filtered juice with $SO_2$; concentrating the so treated juice by evaporation; and crystallizing sugar solids from the concentrated juice, whereby the sugar-containing juice is decolorized and rendered thermally stable relative to further color formation, and the viscosity and the bacterial content of the juice are reduced.

2. A process in accordance with claim 1, wherein the purification of the sugar-containing juice is accomplished in two carbon dioxide contact stages, with the juice being subjected to sedimentation and filtration between the two carbon dioxide contact stages, and the peroxide is added prior to or simultaneously with the first carbon dioxide contact stage.

3. A process in accordance with claim 1, wherein the purification of the sugar-containing juice is accomplished in two carbon dioxide contact stages, with the juice being subjected to sedimentation and filtration between the two carbon dioxide contact stages, and the peroxide is added prior to or simultaneously with the second carbon dioxide contact stage.

4. A process in accordance with claim 3, wherein the pH of the juice during the first carbon dioxide contact stage is maintained at a value of about 10.4 or greater, and the pH of the juice during the second carbon dioxide contact stage is maintained at a value of about 9.0 to 9.5.

5. A process in accordance with claim 1, wherein the purification of the sugar-containing juice is accomplished in two carbon dioxide contact stages, with the juice being subjected to sedimentation and filtration between the two carbon dioxide contact stages, and the peroxide is added prior to or simultaneously with both the first and second carbon dioxide contact stages.

6. A process in accordance with claim 1, wherein the sugar-containing juice is prepared by extraction of sugar from sugar-containing plants by diffusion with water.

7. A process in accordance with claim 1, wherein the sugar-containing juice is prepared by expressing such juice from sugar cane plants.

* * * * *